US011445765B2

(12) United States Patent
Giorgini

(10) Patent No.: US 11,445,765 B2
(45) Date of Patent: Sep. 20, 2022

(54) DYNAMIC VENTILATION SYSTEM FOR SOCKS

(71) Applicant: Trerè Innovation S.r.l, Asola (IT)

(72) Inventor: Fabio Giorgini, Monticelli Brusati (IT)

(73) Assignee: TRERÈ INNOVATION S.R.L, Asola (IT)

( * ) Notice: Subject to any disclaimer, the term of this patent is extended or adjusted under 35 U.S.C. 154(b) by 9 days.

(21) Appl. No.: 16/772,000

(22) PCT Filed: Dec. 6, 2018

(86) PCT No.: PCT/IT2018/000155
§ 371 (c)(1),
(2) Date: Jun. 11, 2020

(87) PCT Pub. No.: WO2019/116405
PCT Pub. Date: Jun. 20, 2019

(65) Prior Publication Data

US 2021/0084991 A1 Mar. 25, 2021

(30) Foreign Application Priority Data

Dec. 12, 2017 (IT) ..... 102017000143190

(51) Int. Cl.
*A41B 11/02* (2006.01)

(52) U.S. Cl.
CPC ..... *A41B 11/02* (2013.01); *A41B 2400/20* (2013.01); *A41B 2400/60* (2013.01)

(58) Field of Classification Search
CPC ..... A41B 11/02; A41B 11/04; A41B 2400/20; A41B 2400/60
(Continued)

(56) References Cited

U.S. PATENT DOCUMENTS 626,864 A * 6/1899 Huse ..... D04B 1/26 66/188
757,424 A * 4/1904 Vohl ..... A43B 7/06 36/3 A
(Continued)

FOREIGN PATENT DOCUMENTS

DE 297 15 762 2/1998
DE 201 11 503 11/2001
(Continued)

OTHER PUBLICATIONS

International Search Report dated Apr. 23, 2019 in International (PCT) Application No. PCT/IT2018/000155.

*Primary Examiner* — F Griffin Hall
(74) *Attorney, Agent, or Firm* — Wenderoth, Lind & Ponack, L.L.P.

(57) ABSTRACT

A dynamic ventilation system for socks including an ergonomic and asymmetric strip structure (3) which contains the plantar arch so as to create internally an integrated aerating sector (4). Further, the system has a first structure with a transparent zone in which an air circulating system is created that is provided for regulating the temperature of the foot and leg, containing a certain quantity of air between skin and sock so as to create an "air chamber" with an effect of insulating from the external environment and a second structure having a plurality of contact sectors (5) that have greater support on the skin that are interrupted by free portions (6) for the passage of air. The system further includes a pair of ribs (11) that create a passage/tunnel for circulating air in addition to increasing Achilles tendon protection in which each rib is a cushion that fills with air.

19 Claims, 3 Drawing Sheets

(58) Field of Classification Search
USPC ..... 2/239
See application file for complete search history.

(56) References Cited

U.S. PATENT DOCUMENTS 2,416,040 A * 2/1947 Armstrong ..... D04B 9/54 66/178 R
3,132,497 A * 5/1964 Garrou ..... C07C 255/00 66/202
3,307,379 A * 3/1967 Adams ..... D04B 9/10 66/178 R
3,995,322 A * 12/1976 Chesebro, Jr. ..... A41B 11/00 2/239
4,057,981 A * 11/1977 Runac ..... D04B 1/102 66/185
4,104,892 A * 8/1978 Thorneburg ..... A41B 11/02 2/239
4,341,096 A * 7/1982 Safrit ..... A41B 11/02 66/185
4,373,361 A * 2/1983 Thorneburg ..... D04B 1/02 66/178 R
4,898,007 A * 2/1990 Dahlgren ..... A41B 11/003 2/239
5,086,518 A * 2/1992 Staley ..... D04B 1/26 2/239
5,095,548 A * 3/1992 Chesebro, Jr. ..... D04B 1/04 2/239
5,226,194 A * 7/1993 Staley ..... A41B 11/005 2/239
5,353,524 A * 10/1994 Brier ..... A43B 17/10 36/55
5,511,323 A * 4/1996 Dahlgren ..... A43B 1/04 2/239
5,603,232 A * 2/1997 Throneburg ..... A41B 11/02 2/239
5,708,985 A * 1/1998 Ogden ..... D04B 1/04 2/239
5,724,836 A * 3/1998 Green ..... D04B 1/02 66/185
5,771,495 A * 6/1998 Turner ..... A41B 11/00 2/239
5,926,852 A * 7/1999 Hudy ..... A41B 11/00 2/239
6,012,177 A * 1/2000 Cortinovis ..... A61F 13/08 2/239
6,016,575 A * 1/2000 Prychak ..... A41B 11/004 2/239
6,032,295 A * 3/2000 Marshall ..... A41B 11/003 2/239
6,286,151 B1 9/2001 Lambertz
6,341,505 B1 * 1/2002 Dahlgren ..... A41B 11/003 2/239
6,536,051 B1 * 3/2003 Oh ..... A41B 11/005 2/239
6,708,348 B1 * 3/2004 Romay ..... D04B 1/26 2/239
7,721,575 B2 * 5/2010 Yokoyama ..... D04B 1/106 66/185
7,971,280 B2 * 7/2011 Kaneda ..... D04B 1/108 2/239
8,230,525 B2 * 7/2012 Lambertz ..... A41B 11/02 2/239
8,544,300 B2 * 10/2013 Kaneda ..... D04B 1/108 66/186
9,226,527 B2 * 1/2016 Dahlgren ..... A41B 11/02
9,828,705 B1 * 11/2017 Shiue ..... D04B 1/12
10,897,932 B2 * 1/2021 Gibson ..... A41B 11/007
2004/0210988 A1 * 10/2004 Lambertz ..... A41D 31/00 2/239
2006/0130217 A1 * 6/2006 Lambertz ..... A41B 11/007 2/239
2006/0143801 A1 7/2006 Lambertz
2007/0033710 A1 2/2007 Lambertz
2007/0118973 A1 * 5/2007 Lambertz ..... A41B 11/006 2/239
2007/0256215 A1 * 11/2007 Lambertz ..... A41B 11/02 2/239
2009/0000339 A1 1/2009 Dahlgren
2009/0095026 A1 4/2009 Araki et al.
2009/0158504 A1 * 6/2009 Sparrow ..... D04B 1/26 2/239
2009/0178179 A1 * 7/2009 Liu ..... A41B 11/00 2/239
2011/0035863 A1 * 2/2011 Lambertz ..... A41B 11/02 2/239
2011/0061149 A1 * 3/2011 Polacco ..... A41B 11/04 2/241
2011/0277218 A1 * 11/2011 Padilla ..... A41B 11/02 2/239
2011/0314591 A1 * 12/2011 Mitsuno ..... A61F 13/08 2/239
2012/0102625 A1 * 5/2012 Klein ..... D04B 1/04 2/239
2014/0157491 A1 * 6/2014 Dahlgren ..... A41B 11/00 2/239
2014/0289924 A1 * 10/2014 Cleveland ..... A61F 13/08 2/2.5
2014/0331387 A1 * 11/2014 Hennings ..... A41B 11/003 2/239
2015/0173428 A1 * 6/2015 Langer ..... A41D 31/18 2/227
2017/0311650 A1 * 11/2017 Hupperets ..... A41B 11/00
2018/0168239 A1 * 6/2018 Riaz ..... A41B 11/00
2018/0279694 A1 * 10/2018 Theno ..... A41D 1/08
2020/0253299 A1 * 8/2020 Ellet ..... A41D 13/06

FOREIGN PATENT DOCUMENTS

DE 202 17 332 4/2003
DE 203 00 973 4/2003

* cited by examiner

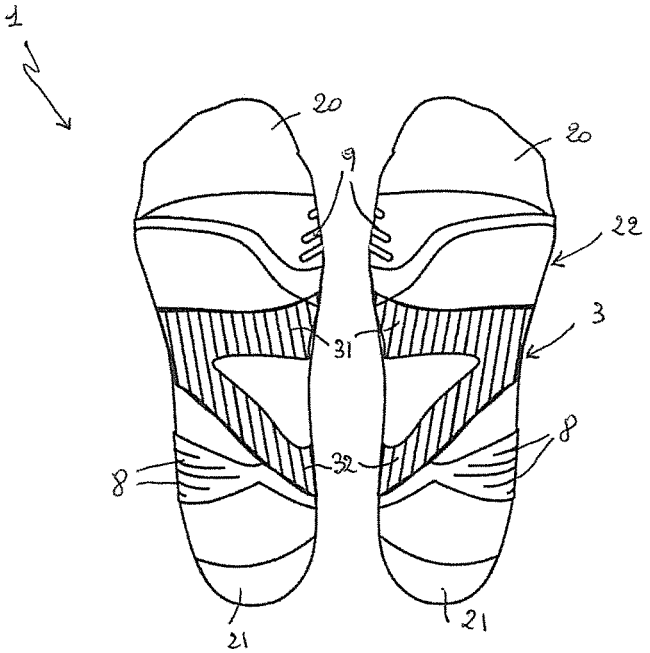
FIG.5
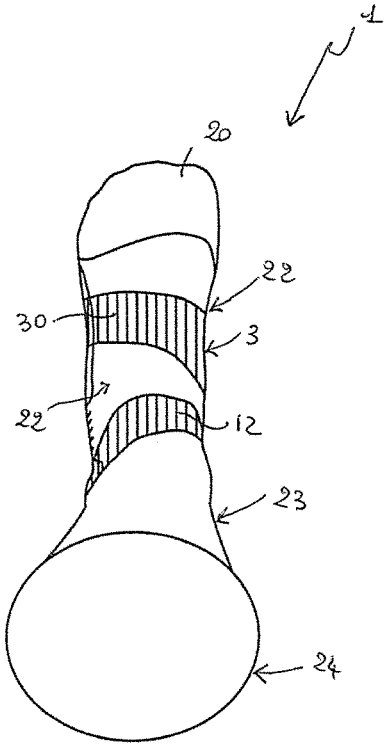
FIG.6
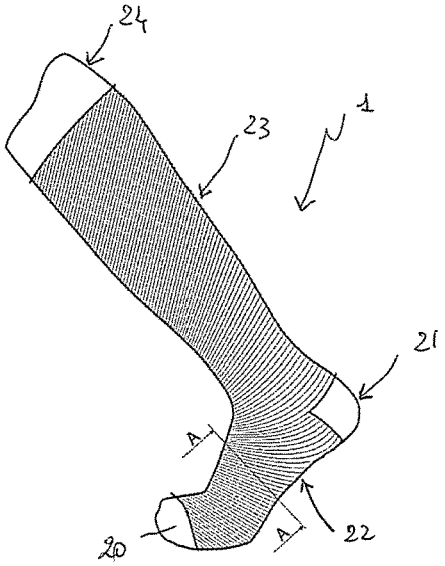
FIG.7
FIG.8
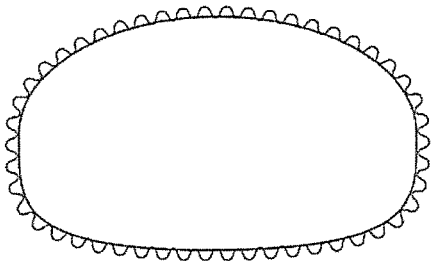

DYNAMIC VENTILATION SYSTEM FOR SOCKS

TECHNICAL FIELD

The present invention relates to a dynamic ventilation system for socks that is particularly suitable for creating differentiated zones having a specific and localized function depending on the position and being able to obtain effective breathability and precise and even heat regulation of the foot and leg, at the same time offering support, cushioning protection and micromassage that helps blood circulation and muscles during sporting activities.

BACKGROUND ART

Today, the need to have garments and in particular socks with increasingly specialist and precise performance is driving research into developing weaving and processing that are increasingly high-performance and aim at being able to respond to specific comfort, heat regulation, resistance, containment, protection, support and sustaining, etc. requirements.

One need that the market has made felt is that of being able to have available for the different sports disciplines socks that are increasingly ergonomic to enable the user to perform an entire series of even extreme movements, in the most total comfort, without any sense of constriction or limitation, at the same time promoting perfect breathability and heat regulation, good protection of the foot and leg with which the sock comes into contact, but also be garments that are resistant to wear and breakage and have a pleasing and attractive aesthetic appearance.

As users know, there is great interest in all those garments and accessories that are comfortable, practical, functional, visually pleasing and flexible in use but are above all provided with a high level of technological performance.

In particular, in the sock sector, above all those used for sporting activities, a very requested aspect is that they breathe so as to let the humidity exit that forms during the sport activity and are thermostatically controlled so as to maintain a constant temperature over time and are at the same time comfortable and protective.

In addition to what has been illustrated so far, socks exist on the market that have so-called "air channels" that permit a certain breathability and the passage of air through the perforations in the mesh that are obtained by retained points that create the hole. The cited air channels are vertical, so that the air passes only along vertical lines that are very limited with the result that there are strips of skin at one temperature whilst those adjacent are at temperatures that gradually increase or decrease according to whether they are near or not near an "air channel". These alternations of temperature create a sensation of heat and cold that is decidedly unpleasant for the user, who does not have a positive and comfortable sensation on the skin but above all on the foot, where sweating is more marked.

In particular, if the temperature increases too much, damage can be caused to the cellular matrix of the muscles because the flow of muscle fibres at certain temperatures and under stress is not optimum.

The cell chemistry that ensures muscle contraction is affected because the temperature jump between a hotter zone and a less hot zone can cause liquid to collect because of the thermal shock in the points in which there is a transition from a hot to a less hot zone from the vascular point of view.

In addition, the effects of the phenomena that have just been illustrated increase when the outside temperature is much lower than the body temperature, as in the case of skiing.

From studies made, it has been found that the lack of dissipation and/or irregular dissipation causes a forced and further temperature increase that leads to an acceleration of the previously mentioned effects that, over time, cause vascular wear.

Further, excessive heat reduces the viscosity of the surfactant liquids present among the muscles with the consequence that performance is reduced, increasing the risk of cell and muscle damage.

In addition to what has been illustrated so far, in the sector of socks for sporting activities there are socks that have so-called "bandaging" that should have the task of containing and protecting the part of the foot and/or of the leg on which this "bandaging" exists but it is only a designated zone that has a merely visual processing differentiation as it does not correspond to a different structure in the fabric that may have compressive and/or holding capacity. This zone is only a psychological help but is not real and effective.

One need that the market has made felt is that of being able to have available, for example, a sock that has a flat and thin mesh fabric and that is at the same time able to exert compression in well defined zones and provide protection in particular zones.

SUMMARY OF INVENTION

One object of the present invention is substantially that of solving the problems of the prior art by overcoming the difficulties disclosed above by a dynamic ventilation system for socks that enables a user to be offered a garment that is able to adapt to physiological features, to the shape of the foot and the leg as a second skin, offering optimum comfort, excellent breathability, good compression at the muscular level and protection of the foot and leg with which the sock comes into contact.

A second object of the present invention is to devise a dynamic ventilation system for socks that bestows structural features on the sock that translate into functional features to be able to protect the foot and leg by responding to the movements, effort, stress and pressures to which the skin, muscles and bones are subjected during movements performed by the user.

A third object of the present invention is to devise a dynamic ventilation system for socks that has zones that are well-defined and bounded according to the type of function and protection that they have to exert.

A further object of the present invention is to devise a dynamic ventilation system for socks that offers zones of control and maintenance of contact with the footwear whilst, in contact with the skin, a comfortable and soft zone is created, thus providing for organized maintenance and breathability sectors.

Not the least of the objects of the present invention is to devise a dynamic ventilation system for socks that is easy to make and very functional.

These objects and still others, which will become more apparent in the course of this description, are substantially reached by a dynamic ventilation system for socks, as claimed below.

BRIEF DESCRIPTION OF DRAWINGS

Further features and advantages will become clearer from the detailed description of a dynamic ventilation system for socks according to the present invention, given here with reference to the attached drawings, which are provided merely for illustrative and thus non-restrictive purposes, in which:

FIG. 5 shows a bottom view of respectively a right and a left sock according to the present invention;

FIG. 6 shows a top view of the sock of FIG. 1;

FIG. 7 shows the diagram of the movement of the air in the sock;

FIG. 8 shows a sectioned view of the sock of FIG. 7;

Figure 1:
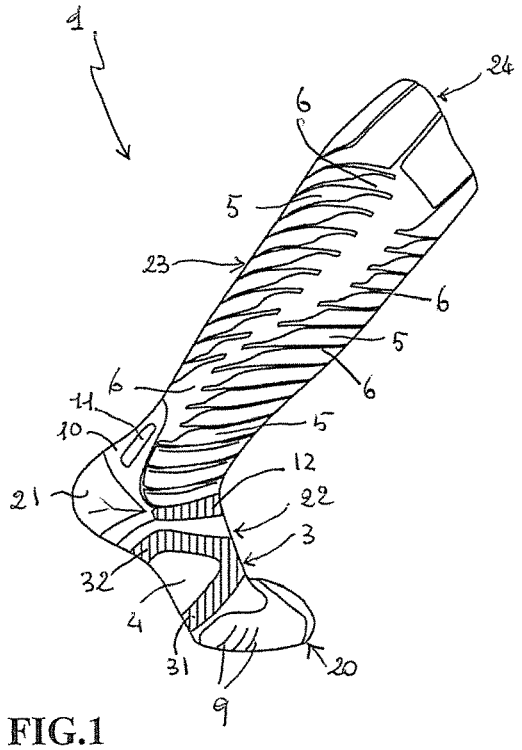
FIG. 1 shows an inner side view of a sock according to the present invention.

With reference to the cited figures, with 1 overall a sock with the dynamic ventilation system according to the present invention has been indicated.

DETAILED DESCRIPTION OF THE INVENTION

As shown in the figures, the sock 1 in question presents itself and is configured as a classic sock with a toe 20, a traditional heel 21, a part 22 that envelops the foot, a part 23 that envelops the ankle and the leg and an elasticated edge 24 provided for adhering to the leg of the user so as to ensure that it does not slide along the leg.

The sock made according to the present invention provides sectors that have different structures and differentiated processing that enable the sock to acquire well defined functional features depending on the zone, as will be better illustrated proceeding with the description.

According to the present invention, the dynamic ventilation system for socks comprises a strip structure 3 that has the task of containing the plantar arch so as to create inside a sector 4 that has a mesh with open and sparse processing, so as to let air pass through.

In particular, the sector 4 is an integrated aerating zone to enable this part of the foot to breath that is very stressed during movements of the sportsperson and/or skier. This integrated aerating zone has very thin and pierced processing to promote the transit of air and a first rapid exit of humidity.

More in detail, the strip structure 3 comprises an upper strip 30, placed in the upper part of the foot approximately half way between the toes and instep, as shown in FIG. 6, which continues in the outer side part of the foot to be divided into a first front strip 31 and a shaped rear strip 32, as shown in FIG. 5, in the sole of the sock.

In particular, the first front strip 31 rotates almost perpendicularly to the longitudinal extent of the foot to connect with the strip 30 in the upper part at the inner side part whilst the second rear strip 32 follows the conformation of the plantar arch as far as the heel to connect and join the first strip 31 and the upper strip 30, always in the inner side part of the foot.

The strip structure 3 that has just been illustrated is ergonomic and asymmetrical and follows the conformation of the foot, surrounding it. In this manner, the plantar arch is supported, being contained, as is clearly visible, observing FIGS. 5 and 6.

More in detail, in order to obtain this type of structure that substantially keeps the aforementioned portions of foot compressed, an additional elastic yarn is used that is processed together with the other yarns used, constraining the elastic yarn in such a manner that it cannot unravel at the start of the portion, processing the meshes and cutting the yarn after again moving the yarn that is constrained according to a pattern that enables very well defined and precise differentiated compression zones to be obtained in portions that are limited and identified amongst the mesh. What has been mentioned about the processing methods is extremely simplified if not oversimplified, but the processing system for obtaining elastic inserts with differentiated compression is illustrated in detail in a patent of the same applicant.

Naturally, in the zone in which the strip 3 is provided, there is a compression value that is greater than the surrounding sector, in this manner, the sector 4 is allowed to act as a piston and move the air in the zone of the plantar arch.

Further, the strip 3, in the part below the foot at the plantar arch, helps support the plantar arch itself, providing a sensation of comfort and containment of the foot so as to stimulate the circulation of the blood, providing at the same time a reinforcement.

In accordance with the present invention, in the sock, the dynamic ventilation system consists of a first structure with a transparent zone in which an air circulating system is created that is provided to regulate the temperature of the foot, contain and maintain a certain quantity of air between the skin and sock so as to create a sort of "air chamber" with the effect of insulating the leg and foot from the outside environment.

In order to obtain this structure, a process is conducted the surface of which is slightly irregular and undulating so as to create an alternation of points of contact with and detachment from the skin with a plurality of microdistances in contact with the skin as shown in FIGS. 7 and 8.

Then, the dynamic ventilation system provides a second structure consisting of a plurality of contact sectors 5 in which greater resting on the skin alternates with a series of free portions 6 for the transit of air, as clearly shown in FIG. 1.

More in detail, the contact sectors 5 that are thicker than the rest of the processing create a sort of guide wall that enables a "tunnel" to be obtained between the contact sectors on the one side and the skin of the leg of the user on the other side.

With this configuration, grooves are created that have the task of acting as a guide for overheated and humid air that has to exit.

In addition to what has been illustrated so far, the contact sectors 5 and the free portions 6 are arranged according to an oblique pattern that rotates around the ankle and leg following a spiral (helical) conformation and also the shape of the contact sectors 5 contributes to creating and interplay of ribs and grooves that enables the distribution of air to be managed by increasing the air flow necessary to the heat regulation and channeling separately the heated air flow for guided expulsion to the edge of the sock, with resetting of the thermal delta between the different zones of the foot.

Figure 3:
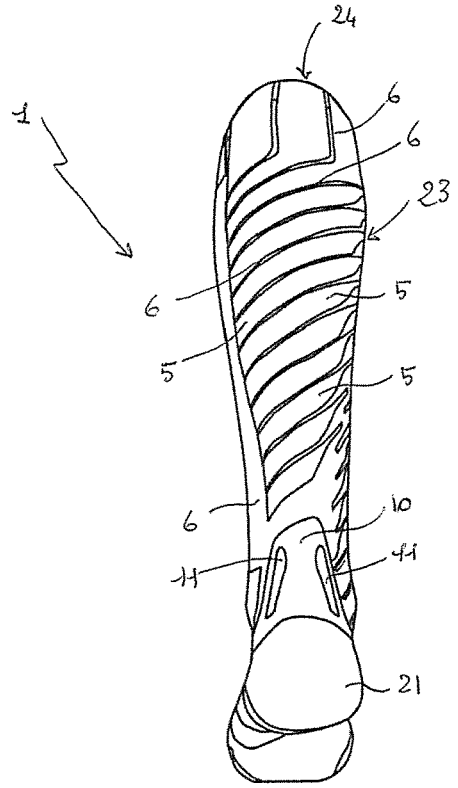
FIG. 3 shows a rear view of the sock in question.
Figure 4:
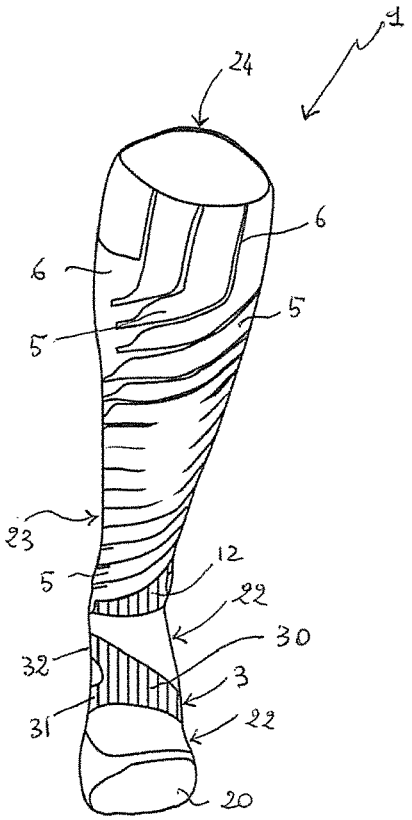
FIG. 4 shows a front view of the sock of FIG. 3.
Figure 9:
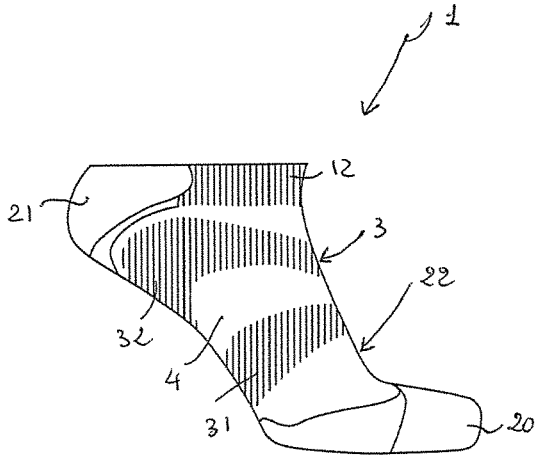
FIG. 9 shows an inner side view of another sock according to the present invention.
Figure 10:
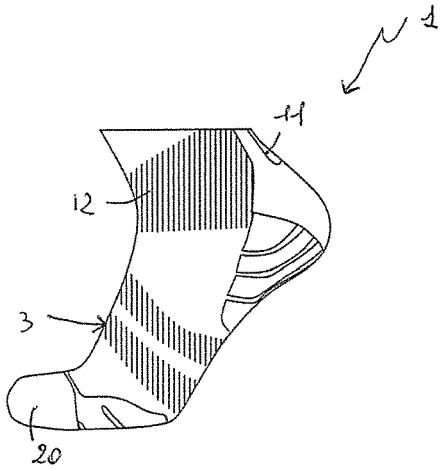
FIG. 10 shows an outer side view of the sock of FIG. 9.

Further, the particular end profiling of the contact sectors 5 channels in an even more directed manner the flow of the air in the upper part of the sock to the exterior as shown in FIGS. 3 and 4.

In particular, unlike prior-art air channels, diagonal processing enables different distances to be in contact with the skin.

As mentioned previously, processing is oblique and microdistances are processed so that the air is channelled to move and exit through a spiral path. This particular processing of the mesh is reflected in a structure that promotes upward movement of the air and thus also of the humidity that the air absorbs.

In fact, with the configuration of the dynamic ventilation system, microcirculation of air is obtained that is due to the first structure and macrocirculation is obtained that is due to the second spiral structure so that a uniform and homogeneous temperature of the leg is obtained to as along the entire surface there is a continuous and uniform movement and passage of air, unlike what happens with prior art sockets in which the aerating channels are vertical and thus the passage of air is limited to single lines. Further, the method of making the air and humidity exit the socks of the prior art with vertical air channels makes the air and humidity exit once the sweat has passed through the mesh whereas in the case of the dynamic ventilation system it already acts inside immediately on the skin, which in this manner is always dry and thermoregulated. In addition to what has been illustrated so far, with the dynamic ventilation system in question a "vacuum effect" is created so that the air exits easily because of the pressure difference that is created between the ankle and the leg. This dynamic is obtained by the fact that the pressure on the ankle is greater because the spiral has smaller dimensions whereas rising up the leg, the dimensions of the spiral increase and the pressure decreases so that the top zone of the sock that is less pressurized attracts air upwards to balance the pressure difference between the two levels and, consequently, the rise and exit of air is facilitated and promoted.

This dynamic is further implemented by the muscular action of the sportsperson, which by contracting and releasing the muscle acts as a sort of natural pump.

In a prior-art sock, in the sole the sector designed to fill up with humidity is made of sponge that becomes wet, making the sock heavy as the air exits only from the holes present in the channels so that it gives the user a sensation of wetness in contact with the skin whereas with the dynamic ventilation system the skin is aerated and is maintained dry, like the sock, which is soft, light and very comfortable.

According to the present invention, the conformation of the strip structure 3, in addition to preserving and protecting the plantar arch and stabilizing the movement of the metatarsus, enables the air and humidity to be taken away from under the foot by conveying the air and humidity to the side part of the foot and directing the air and humidity upwards and towards the spiral as far as the edge because the sector 4 operates as a bellows.

According to this embodiment, the contact sectors 5 have fuller mesh processing as it is made with sponge processing, but they are interrupted by the presence of the free portions 6 that act as a tunnel for moving and circulating the air. Further, the contact sectors 5 achieved by sponge processing are able to perform the task of protecting the calf and shin from blows and stress whereas on the side the free portions 6 have an open mesh because the side part of the leg is much less subject to blows, being thus provided with greater spaces to increase the exit of air and thus of humidity. What has been disclosed is present in a skiing sock whereas for other models suitable for other types of sport, where the need for breathability is more limited, the axial tilt of the spiral line is reduced to calibrate air movement appropriately.

Further, in order to support the dynamic ventilation system, the sock has control and holding zones for controlling and holding the foot that are obtained with reinforced points that give greater resistance to the movement between foot, sock and footwear.

Figure 11:
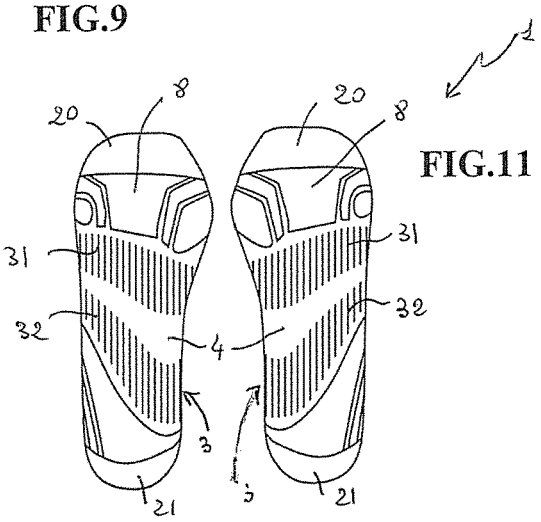
FIG. 11 shows a bottom view respectively of a right and left sock of the sock of FIG. 9.
Figure 12:
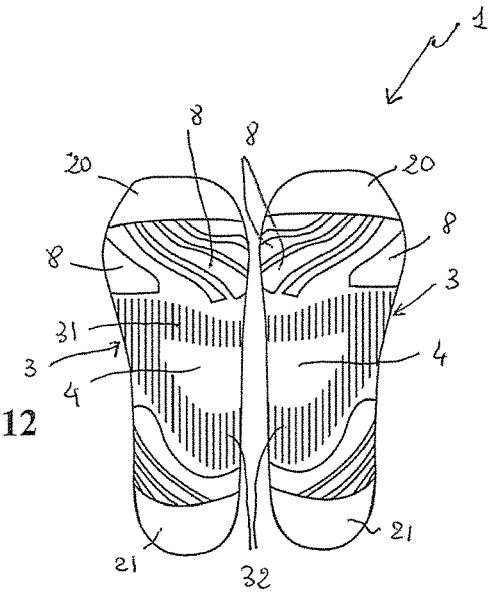
FIG. 12 shows a bottom view respectively of a right and left sock of a further sock according to the present invention.
Figure 13:
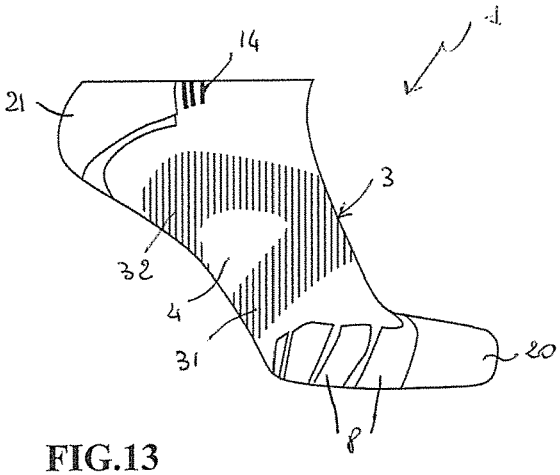
FIG. 13 shows an inner side view of the sock of FIG. 12.
Figure 14:
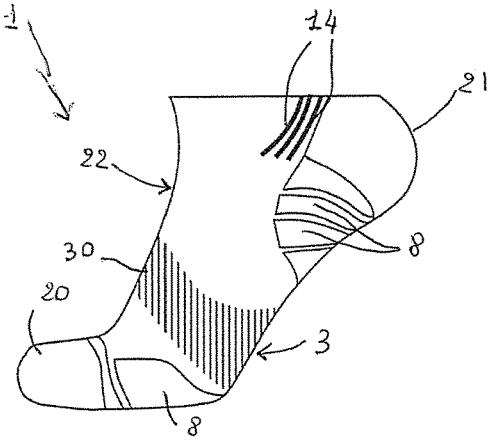
FIG. 14 shows an outer side view of the sock of FIG. 13.

More in detail, for example, in a running sock the control and holding zones are essentially three: two lateral zones in the foot-supporting zone and the third in the heel, as shown in FIGS. 12 and 14. These control and holding points enable the sock to be kept immobile with respect to the footwear so that friction actions are not created that could alter the movement of the air and the humidity and the path thereof to the exterior, creating anomalous vortices due to the movement and/or the effort that the foot of the user makes during the activity of running, Otherwise, as shown in FIG. 11, in a cycling and/or mountain biking sock there is only one control and holding zone 8 that is placed centrally at the metatarsus and enables the sock not to move during pedalling, making the air circulate correctly from the plantar arch to the exterior in addition to enabling correct force to be exerted during the step of pushing on the pedal.

Figure 2:
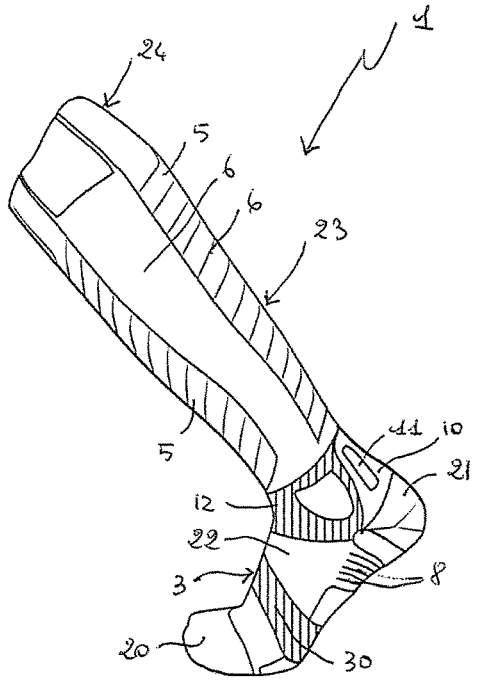
FIG. 2 shows an outer side view of the sock of FIG. 1.

Lastly, the skiing sock has a control and holding zone 8 outside the foot laterally near the heel, as shown in FIG. 2. This arrangement of the control and holding zone enables the skier not to have relative movements between the foot and boot when forcing movement in a bend. In this manner, a good hold is obtained in the boot and movements are avoided that could excessively stretch the tendons and above all the ligaments.

In fact, the sock, in order to be comfortable and perform the breathability and heat regulation functions, must become a second skin and for this reason it is important that there are no relative sliding zones, so the foot must have a sensation of stability and immobility inside the footwear.

In addition, the skiing sock has—on the inner side portion near the toes in the zone of the big toe—a zone provided with ribs 9 arranged parallel to one another and located in a position where friction phenomena must not occur on the skin following movements of the foot, so that it is possible to make the air circulate further, creating another further passage of air. Further, processing is slightly raised and made with yarn that withstands the wear from contact with the boot.

In accordance with the present invention, the sock has a reinforced sector 10 for protecting the Achilles tendon from blows and friction against the shoe/ski boot.

Further, there are two lines that make up a pair of raised ribs 11 whose task is to increase protection of the Achilles tendon and create a passage/tunnel for making air circulate also in this zone.

More in detail, each rib 11 is like a strip placed to the side of the Achilles tendon to allow greater protection when a user wears, for example, a ski boot that is particularly stiff. This protection enables the skin of the user to be spaced apart from the structure of the boot, so that during movements that are often rapid and forceful the rear part of the foot that has the Achilles tendon is protected further also because of the presence of the reinforced sector 10 that is obtained by sponge processing that has a cushioning effect. Further, the pair of ribs 11 is placed outside and has the task of protecting the rubbing part, thus having an effect that cushions further as each rib has a three-dimensional configuration.

In particular, each rib is like a cushion that fills with air when it is obtained with processing that is such as to create inside the cushion small cavities within which there is air.

According to the present invention, in the running sock there are spacers 14 on both sides below the malleolus. These spacers are slightly curved to adapt to the morphology of the underside of the malleolus and, inside between one another, produce an air passage as they create a small thickness against the footwear.

In the trekking sock there are ribs in the malleolus zone that are made in the same way as the ribs 11 of the Achilles tendon that were illustrated above that are needed to create an air passage in addition to protecting the malleolus by distancing the malleolus from the shoe.

As illustrated previously, the dynamic ventilation system of the sock provides passages consisting of the free portions 6 that rotate around the leg so as to make the air move upwards. The free portions 6 continue in the elastic edge that are substantially equidistant in the front and rear part of the sock whereas in the side part they are slightly more spaced apart, as shown in FIG. 2.

As illustrated previously, the space of the spiral increases as it rises towards the elastic edge.

Further, the edge 24 of the sock has an anatomical shape that adapts better and conforms to the muscle so that the sock has much greater difficulty in slipping down. In fact, the edge is higher at the rear to rest better on the muscle, as shown in FIG. 7.

In addition to what has been illustrated so far, the sock has a further strip 12 placed astride the instep of the foot and provided for containing the instep joint by controlling the type of instep movement possible. The strip 12 around the ankle is found in skiing, running, trekking and cycling socks where compression of the malleolus/ankle zone is required to maintain the ankle more immobile. This strip is located inside the sponge processing of the malleolus zone. The strip 12 extends from near the heel in the outer part of the sock to continue on the front on the instep to divide around the malleolus in the inner part of the foot and terminating near the three-dimensional protection of the Achilles heel.

As mentioned, the strip 12 is integrated inside the sponge protection of the malleolus and is made with a process in which a cut elastic thread is used that enables stability and compression to be bestowed.

In addition, the protection of the malleolus is integrated into the processing so that there is no presence of ridges and protrusions that could be irritating once the foot is enclosed in a shoe/boot. In particular, in the skiing sock, the malleolus protection is positioned in the sectors where the user exerts a load when making curves to protect the portion of the foot under pressure, i.e. in the zone of the internal malleolus and is always integrated in order not to have elements that could cause irritation in contact with the stiff boot. It is an asymmetric protection.

In addition, the strips 3 and 12 create figures that are ornamental from an aesthetic point of view but which have a very precise function of providing very specific compression that contributes to stimulating the circulation of the blood in soft tissue below the malleolus, when they are placed around the malleolus, and contribute to stabilizing the inner compartment of the ankle joint.

In particular, the protective strips 3 and 12 enable an effective massaging effect to be obtained that offers a sensation of comfort to the user that makes the movement safer and more supported.

The dimensions of the protective strips can vary slightly in the sole to respond better to the stress of the movements in various sporting disciplines.

In addition to what has been illustrated so far, in the sock the sector 4 can have dimensions and conformations that differ slightly according to the sports disciplines. In fact, for example, in a cycling sock, the need to have a strip 3 of greater dimensions for greater stability and holding of the foot would reduce the surface of the sector 4 that is extended to have an equivalent breathable surface.

Otherwise, in a running sock, the strip 3 is narrower because there is a need to promote movement of the foot whereas in a cycling sock the strip is wider because the foot moves less.

In accordance with the present invention, all the structures and zones are specular in the two socks: right sock and left sock to perform anatomical conformation of the foot and leg better. In addition to what has been illustrated so far, the sock has in processing the feature of having a mesh that is comfortable and soft in contact with the skin of the user or inside to offer optimum comfort, a sensation of wellbeing and avoid irritating phenomena or allergic reactions whereas outside there is processing that gives the sock good resistance to wear due to rubbing with shoes or boots.

The fibres used for making the sock are both natural and synthetic.

From what has been disclosed in a mainly structural sense, the operation of the invention in question is as follows.

When a user intends to engage in a specific sporting activity where a series of repetitive movements are performed and which require effort, the sportsperson merely needs to wear a sock according to the present invention that is specific for the type of sporting activity in order to have a correct and suitable circulation of air and consequently good breathability that ensures a pleasant sensation on the skin and optimum comfort. Further, the sock enables the user to be helped and supported in addition to being protected in the various movements and efforts.

The present invention thus achieves the proposed objects.

The dynamic ventilation system for socks enables a user to be offered a garment that is able to adapt to physiological features, to the shape of the foot and the leg as a second skin, offering optimum comfort, excellent breathability with appropriate air circulation, good compression at the muscular level and protection of the foot and leg with which the sock comes into contact.

Advantageously, with the dynamic ventilation system for socks, structural features are bestowed on the sock, features that translate into functional features so as to be able to protect the foot and leg by responding to the movements, effort, stress and pressures to which the skin, muscles and bones are subjected during movements performed by the user, maintaining the skin, muscles and bones at an optimum temperature.

Further, the dynamic ventilation system for socks has zones that are well defined and bounded according to the type of function and protection that they have to exert.

In fact, the dynamic ventilation system for socks comprises zones that promote correct circulation of the air to have a dry zone with a comfortable and soft sensation in contact with the skin and creating organized sectors of holding and breathability and exit of the humidity that is created with the movement.

Advantageously, the sock with the dynamic ventilation system in question adapts perfectly to the morphology of the body without irritating thicknesses and has precise portions with differing compression with respect to the mesh present in the same range.

One advantage obtained with the presented dynamic ventilation system is that of having a sock that enables the performance of the user to be increased inasmuch as the elements of disturbance and irritation are reduced, making the movements and efforts of the user more secure. In particular, by reducing the stress factors, also the state after the sporting activity is improved, enabling the user to be assisted in recuperating physically more rapidly. A further advantage is due to the fact that the dynamic ventilation system for socks in question is easy to make and very functional.

Needless to say, numerous amendments to and variations on the invention can be made that all fall within the scope of the inventive concept that characterizes the invention.

The invention claimed is:

1. A dynamically ventilated sock comprising:

a toe;

a heel;

a part adapted to envelop a foot of a user;

a part configured to envelop an ankle and a leg of the user; and an elasticated edge configured to adhere to the leg of the user, wherein the sock further comprises a dynamic ventilation system formed of sectors that have different structures and differentiated knitting that enable the sock to acquire well defined functional characteristics, the sectors that have different structures comprising:

an ergonomic and asymmetric strip structure configured to follow a conformation of the foot, and to contain a plantar arch of the user so as to define a first sector that has a thin mesh with open and sparse knitting to promote the transit of air and a first rapid exit of humidity, the first sector being an integrated aerating portion to enable a corresponding zone of the foot to breathe during movements of the user;

a first structure with a breathability zone in which an air circulating system is created that is provided for regulating a temperature of the foot and the leg, and for containing and maintaining air between skin of the user and the sock so as to create an air chamber with an effect of insulating the foot and leg from an external environment, the first structure being formed by a mesh which is knitted such that a surface of the mesh is irregular and undulating so as to create an alternation of points of contact with and detachment from the skin with a plurality of microdistances in contact with the skin;

a second structure consisting of a plurality of contact sectors alternatingly interrupted by a plurality of free portions for the passage of the air, the plurality of contact sectors having greater support on the skin than the free portions, wherein the contact sectors are thicker than the free portions and are configured to create guide walls that enable the free portions to act as tunnels between adjacent pairs of the contact sectors on one side, and the leg of the user on another side, so as to act as a guide for overheated and humid air that has to exit, wherein the plurality of contact sectors and the plurality of free portions are arranged according to an oblique pattern configured to rotate around the ankle and the leg following a spiral conformation in which the contact sectors contribute to creating an interplay of ridges and grooves that enable a distribution of the air to be managed by increasing the flow of air required for heat regulation and by channeling separately a heated air flow for guided expulsion to the edge of the sock with resetting of a thermal delta of the foot, the second structure having a shape of a spiral that gradually increases towards the elasticated edge; and a pair of first ribs that are configured as two raised lines so as to create a passage for circulating air and so as to protect an Achilles tendon of the user, wherein each first rib is a cushion that fills with air and has knitting so as to create inside small cavities within which air is present, the dynamic ventilation system being configured to aerate the skin of the user and maintain a dry state during exertions of the user.

2. The dynamically ventilated sock according to claim 1, wherein the strip structure comprises an upper strip configured to extend along an upper part of the foot approximately half way between toes of the user and an instep of the user to an outer lateral part of the foot, and to divide into a front strip and a rear strip in a sole of the sock, wherein the front strip is configured to extend almost perpendicularly to a longitudinal extent of the foot to connect with the upper strip at an inner lateral side of the upper part of the foot, and wherein the rear strip is configured to follow a conformation of a plantar arch of the user almost as far as the heel and to connect with and join the front strip and the upper strip at an inner lateral part of the foot.

3. The dynamically ventilated sock according to claim 1, wherein the strip structure is configured to preserve and protect the plantar arch and to stabilize a movement of the metatarsus of the user, to enable air and humidity to be taken from below the foot, to convey the air and humidity to a lateral part of the foot, and to direct the air and humidity upwards to the spiral and as far as the elasticated edge, and wherein the strip structure has a compression value that is greater than that of a portion surrounding the strip structure such that the first sector is enabled to act as a piston and move the air toward the plantar arch.

4. The dynamically ventilated sock according to claim 1, wherein the dynamic ventilation system is configured to create a microcirculation of air that is due to the first structure and a macrocirculation of air due to the spiral conformation of the second structure so that a uniform and homogeneous temperature of the foot and of the leg is obtained as along an entire surface there is continuous and constant movement and passage of air, and the exit of air and humidity starts internally immediately on the skin.

5. The dynamically ventilated sock according to claim 1, wherein the plurality of contact sectors have a fuller mesh processing that is made with sponge processing configured to protect a calf and a shin of the user from blows and stress, and are alternatingly interrupted by the free portions that act as tunnels for moving and circulating the air, the free portions having laterally an open mesh to ensure the presence of greater spaces to increase the exit of air and humidity.

6. The dynamically ventilated sock according to claim 1, wherein the contact sectors have an end profile that directs the flow of the air into an upper part of the sock to the exterior.

7. The dynamically ventilated sock according to claim 1, wherein the plurality of contact sectors and the plurality of free portions are arranged in an oblique manner, such that the humid air is channelled to move and exit through a spiral path, assisted by end profiling of the contact sectors, that channels the flow of the humid air in an upper part of the sock to the exterior.

8. The dynamically ventilated sock according to claim 1, wherein the free portions are configured to rotate around the leg so as to make the air rise upwards, and the free portions continue substantially equidistant in the elasticated edge in a front part and a rear part of the sock whereas in a lateral part of the sock the free portions are more distanced than the free portions in the front part and the rear part.

9. The dynamically ventilated sock according to claim 1, wherein the spiral is configured to have smaller dimensions at the ankle and increasing dimensions along the leg such that a pressure difference is created between a higher pressure at the ankle and a lower pressure at an upper part of the sock, the pressure difference causing a vacuum effect which draws the air upwards to balance the pressure difference, thereby facilitating and promoting the ascent and exit of the air.

10. The dynamically ventilated sock according to claim 1, further comprising control and holding zones, configured for controlling and holding the foot, obtained with reinforced points that attribute resistance to relative movement between the foot, the sock and footwear, wherein the sock is a running sock, and the control and holding zones include two lateral control and holding zones in a foot-supporting zone, and a third control and holding zone in the heel, and wherein the control and holding zones enable the sock to be kept immobile with respect to the footwear so that friction actions are not created that could alter the movement of the humid air and the path thereof to the exterior due to movement or effort that the foot of the user makes during running.

11. The dynamically ventilated sock according to claim 1, further comprising only one control and holding zone, configured for controlling and holding the foot, obtained with reinforced points that attribute resistance to relative movement between the foot, the sock and footwear, wherein the sock is a cycling or mountain biking sock, and wherein the only one control and holding zone is configured to be placed centrally at the metatarsus of the user to prevent the sock from moving during pedalling, making the air circulate correctly from the plantar arch to the exterior in addition to exerting a correct force during pushing on a pedal by the user.

12. The dynamically ventilated sock according to claim 1, further comprising control and holding zones, configured for controlling and holding the foot, obtained with reinforced points that attribute resistance to relative movement between the foot, the sock and footwear, wherein the sock is a skiing sock, and the control and holding zones include a control and holding zone that is configured to be located outside the foot laterally near the heel to prevent a skier from having corresponding movements between the foot and a boot when movement is forced in a bend so as to obtain a holding in the boot and avoid movements that could lead to tension of tendons and ligaments.

13. The dynamically ventilated sock according to claim 1, wherein the sock is a skiing sock, the skiing sock further comprising a portion provided with second ribs arranged parallel to one another on an inner lateral portion near a big toe of the user, so as to avoid a friction phenomena on the skin following movement of the foot, and so that a further passage and circulation of air is created, the second ribs having raised knitting made with a yarn that withstands wear from rubbing.

14. The dynamically ventilated sock according to claim 1, wherein each first rib has a three dimensional configuration, has the form of a strip configured to be placed laterally to the Achilles tendon, and is symmetrical to ensure protection when the user wears stiff footwear, each first rib distancing internally the skin of the user from the footwear so that a rear part of the foot that includes the Achilles tendon is further protected, the first ribs being arranged in a reinforced sector that is obtained with sponge processing and that has a cushioning effect to protect the Achilles tendon from shocks and friction against the footwear.

15. The dynamically ventilated sock according to claim 1, wherein the sock is a running sock, the running sock further comprising spacers configured to be located on both lateral sides of and below a malleolus of the user such that each spacer creates a shim against footwear worn by the user so as to form an air passage between the spacers, the spacers being curvilinear so as to adapt to a morphology of a region below the malleolus.

16. The dynamically ventilated sock according to claim 1, wherein the sock is a hiking sock, the hiking sock further comprising second ribs configured to be located below a malleolus of the user so as to create an air passage and protect the malleolus by distancing the malleolus from footwear worn by the user, each second rib being a cushion that fills with air and has knitting so as to create inside small cavities within which air is present.

17. The dynamically ventilated sock according to claim 1, wherein the elasticated edge of the sock has an anatomic shape that adapts and conforms to a leg muscle of the user so that the sock resists slipping down, and the elasticated edge is higher at a rear of the sock so as to rest securely on the leg muscle.

18. The dynamically ventilated sock according to claim 1, the strip structure is formed by an elastic yarn is used that is worked together with other yarns used to constrain the elastic yarn at a start of the strip structure, and working meshes and cutting the elastic yarn after again constraining the elastic yarn so that it does not unravel according to a pattern that enables differentiated compression zones to be obtained.

19. The dynamically ventilated sock according to claim 1, wherein the sock is one sock of a pair of socks, all the structures and zones of the one sock being mirrored in the other sock so as to follow respective anatomic conformations of left and right feet and left and right legs of the user, each sock having a mesh in contact with the skin of the user to offer optimal comfort, a sensation of wellbeing and avoid irritating phenomena or allergic reactions, and knitted portions are provided on an exterior of each sock that give the sock resistance to wear due to rubbing against footwear as fibres used to make the sock are both natural and synthetic.

* * * * *